US010308484B2

(12) United States Patent
Bergeron

(10) Patent No.: US 10,308,484 B2
(45) Date of Patent: Jun. 4, 2019

(54) POWER BUCKET

(71) Applicant: Raymond Bergeron, Trenton, MI (US)

(72) Inventor: Raymond Bergeron, Trenton, MI (US)

( * ) Notice: Subject to any disclaimer, the term of this patent is extended or adjusted under 35 U.S.C. 154(b) by 193 days.

(21) Appl. No.: 15/606,604

(22) Filed: May 26, 2017

(65) Prior Publication Data

US 2018/0339887 A1 Nov. 29, 2018

(51) Int. Cl.

| | |
|---|---|
| ***E02F 3/47*** | (2006.01) |
| ***B66C 3/00*** | (2006.01) |
| ***B66C 3/02*** | (2006.01) |
| ***E02F 3/38*** | (2006.01) |
| ***E02F 3/413*** | (2006.01) |
| ***B66C 3/16*** | (2006.01) |
| *B66C 3/06* | (2006.01) |

(52) U.S. Cl.

CPC ..... *B66C 3/005* (2013.01); *B66C 3/02* (2013.01); *B66C 3/16* (2013.01); *E02F 3/384* (2013.01); *E02F 3/413* (2013.01); *B66C 3/06* (2013.01); *E02F 3/47* (2013.01)

(58) Field of Classification Search

CPC .... B66C 3/02; B66C 3/16; E02F 3/342; E02F 3/404; E02F 3/413; E02F 3/47; E02F 3/60

USPC ..... 37/184, 341, 461

See application file for complete search history.

(56) References Cited

U.S. PATENT DOCUMENTS

| | | | | |
|---|---|---|---|---|
| 2,605,563 | A * | 8/1952 | Browning | B66C 3/16 212/251 |
| 3,061,957 | A * | 11/1962 | Fehlmann | B66C 3/16 37/187 |
| 3,722,448 | A * | 3/1973 | Leonardi | B63C 7/24 114/55 |
| 3,737,059 | A * | 6/1973 | Peterson | E02F 3/404 37/184 |
| 3,877,743 | A | 4/1975 | Johnson | |
| 4,327,943 | A * | 5/1982 | Longo | E02F 3/413 294/68.23 |
| 5,193,873 | A | 3/1993 | Juliusz et al. | |
| 5,653,489 | A | 8/1997 | Fandrich et al. | |
| 6,347,464 | B1 * | 2/2002 | Klager | B66C 3/02 294/68.23 |
| 9,452,912 | B1 * | 9/2016 | Bergeron | B66C 3/02 |
| 2016/0280514 | A1 | 9/2016 | Bergeron | |

FOREIGN PATENT DOCUMENTS

| | | | |
|---|---|---|---|
| CN | 104944280 | A | 9/2015 |

* cited by examiner

*Primary Examiner* — Gary S Hartmann
(74) *Attorney, Agent, or Firm* — Dinsmore & Shohl LLP

(57) ABSTRACT

A power bucket having a first and second bucket half pivotally secured together about a main axis by a pivot pin. The bucket halves are movable between an open and a closed position. A head is disposed above the bucket halves and at least one arm pivotally connects the head to one bucket half while at least one second arm is pivotally connected between the head and the other bucket half. A cylinder support is pivotally mounted to the pivot pin and one end of a hydraulic cylinder is attached to the pivot support. The other end of the cylinder is attached to the bucket. Upon actuation of the cylinders, the cylinders move the bucket halves so that a cutting edge of the bucket half moves in a substantially horizontal plane.

5 Claims, 5 Drawing Sheets

POWER BUCKET

BACKGROUND OF THE INVENTION

I. Field of the Invention

The present invention relates generally to power buckets.

II. Description of Related Art

There are many previously known power buckets that are used in a number of different applications. These applications include loading and unloading cargo, such as grain, underwater dredging, and the like. Furthermore, for underwater dredging operations, the previously known power buckets typically scoop a rather thick divot from the bottom of the bed. Consequently, these previously known buckets are adequate for forming or deepening trenches along the water bed.

In some situations, however, it is not desirable to remove a significant depth of earth during the dredging operation. For example, in the event of an undesirable environmental spill, it is only desired to remove the spill itself and not the underlying uncontaminated soil.

Furthermore, the material dredged from the area of the environmental spill requires careful and costly disposal procedures. As such, it is highly desirable to remove only the contaminated area in an environmental spill area while removing only a minimal amount of uncontaminated soil.

SUMMARY OF THE PRESENT INVENTION

The present invention provides a power bucket which overcomes the above-mentioned disadvantages of the previously known power buckets. In particular, unlike the previously known power buckets, the power bucket of the present invention moves the cutting edges of the power bucket in a substantially horizontal plane as the bucket is moved between its open and closed positions. As such, it is possible to remove only the contaminated material from the water bed while minimizing the amount of uncontaminated earth removed from the water bed. This, in turn, reduces the overall cost of disposal of the contaminated soil.

In brief, the power bucket of the present invention includes a first and second bucket half which are pivotally secured together about a main axis by one or more pivot pins. Each bucket half is movable between an open and a closed position and, in doing so, the cutting edge of the power bucket moves in a substantially horizontal plane.

A lifting crane manipulates the position of the bucket by a power cable attached to a head which is disposed above the bucket halves.

The bucket halves are then secured to the head by at least two arms that are pivotally secured together at the head at one end and pivotally secured to the first and second bucket halves at their other end. As such, the arms control the vertical position of the bucket halves as the bucket halves are moved between their open and closed positions.

In order to move the bucket halves between their open and closed positions, a cylinder support is pivotally mounted to each pivot pin so that the cylinder support is positioned radially outwardly from the axis of the pivot pin. A power cylinder is then pivotally connected at one end to the cylinder support and, at its other end, to its associated bucket half. Consequently, upon actuation of the power cylinders, the power cylinders simultaneously pivot the power bucket halves about the pivot pins securing the bucket halves together. Simultaneously, the head and its connection through the arms to the bucket halves vertically displace the cutting edge of the bucket halves so that the edge remains substantially vertically constant throughout the entire range of the movement of the bucket halves. This, in turn, produces a level cut that can be closely and accurately manipulated by the crane operator.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

With reference first to FIGS. 1, 4-7, a preferred embodiment of a power bucket 20 according to the present invention is shown. Only one end of the bucket 20 will be described in detail, it being understood that a like description shall also apply to the other end of the bucket 20.

The power bucket 20 includes two bucket halves 22 and 24 which are pivotally secured adjacent the top of the bucket halves 22 and 24 by a pivot pin 26. The pivot pin 26 is preferably cylindrical in shape and made from steel. One such pivot pin 26 is disposed at each end of the power bucket 20.

Figure 1:
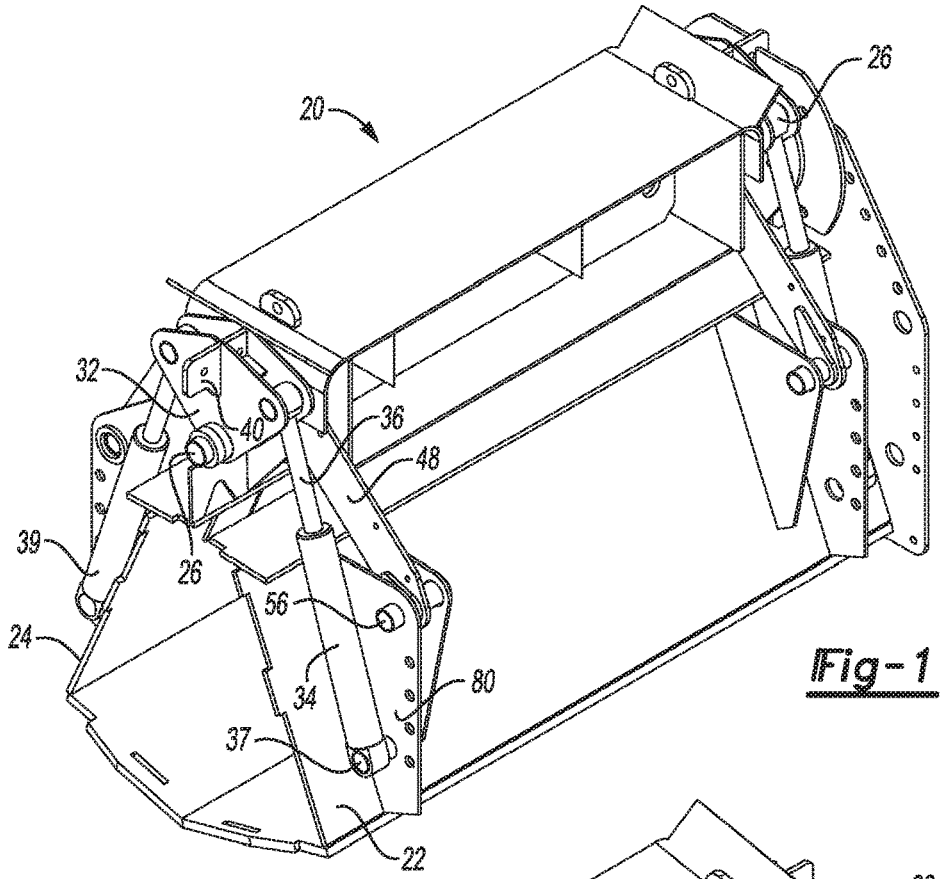
FIG. 1 is an elevational view of a preferred embodiment of the invention in the closed position and with the end cover removed for clarity.
Figure 2:
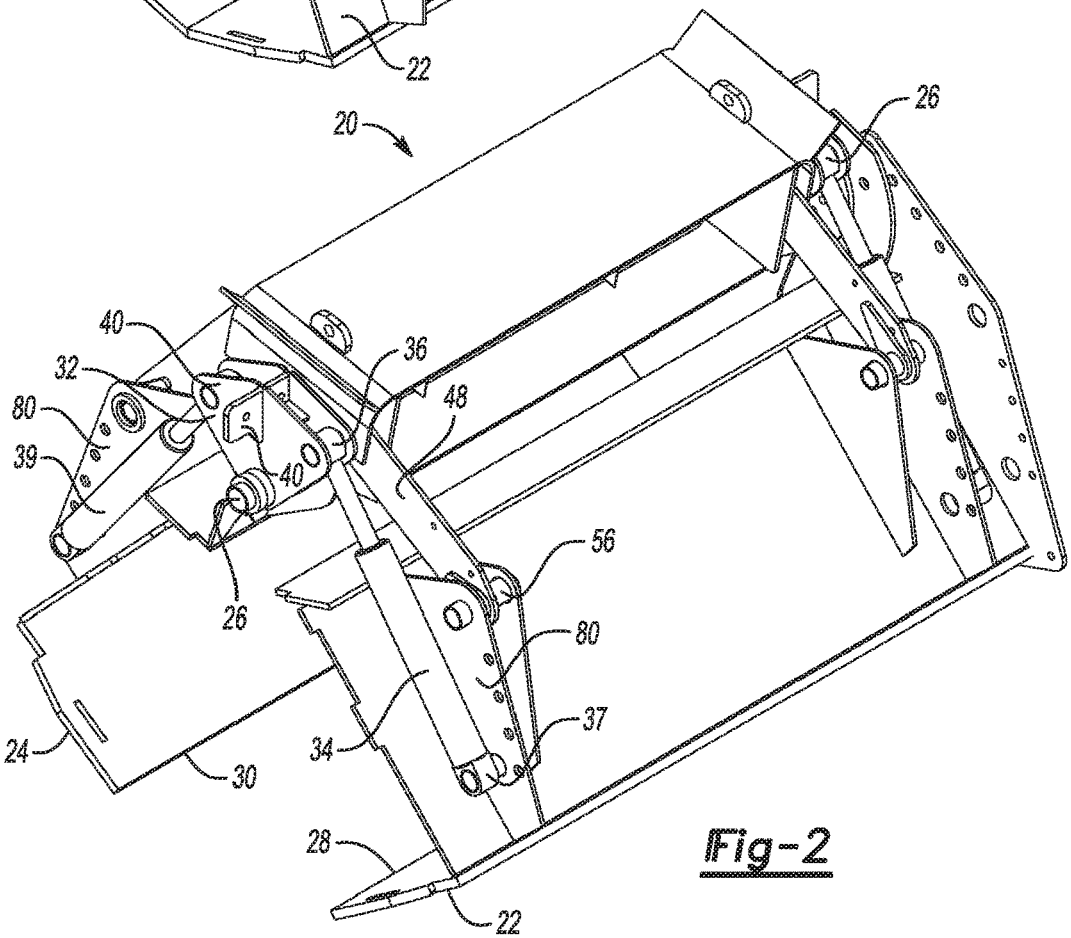
FIG. 2 is an elevational view of a preferred embodiment of the invention in the partially opened position and with the end cover removed for clarity.
Figure 3:
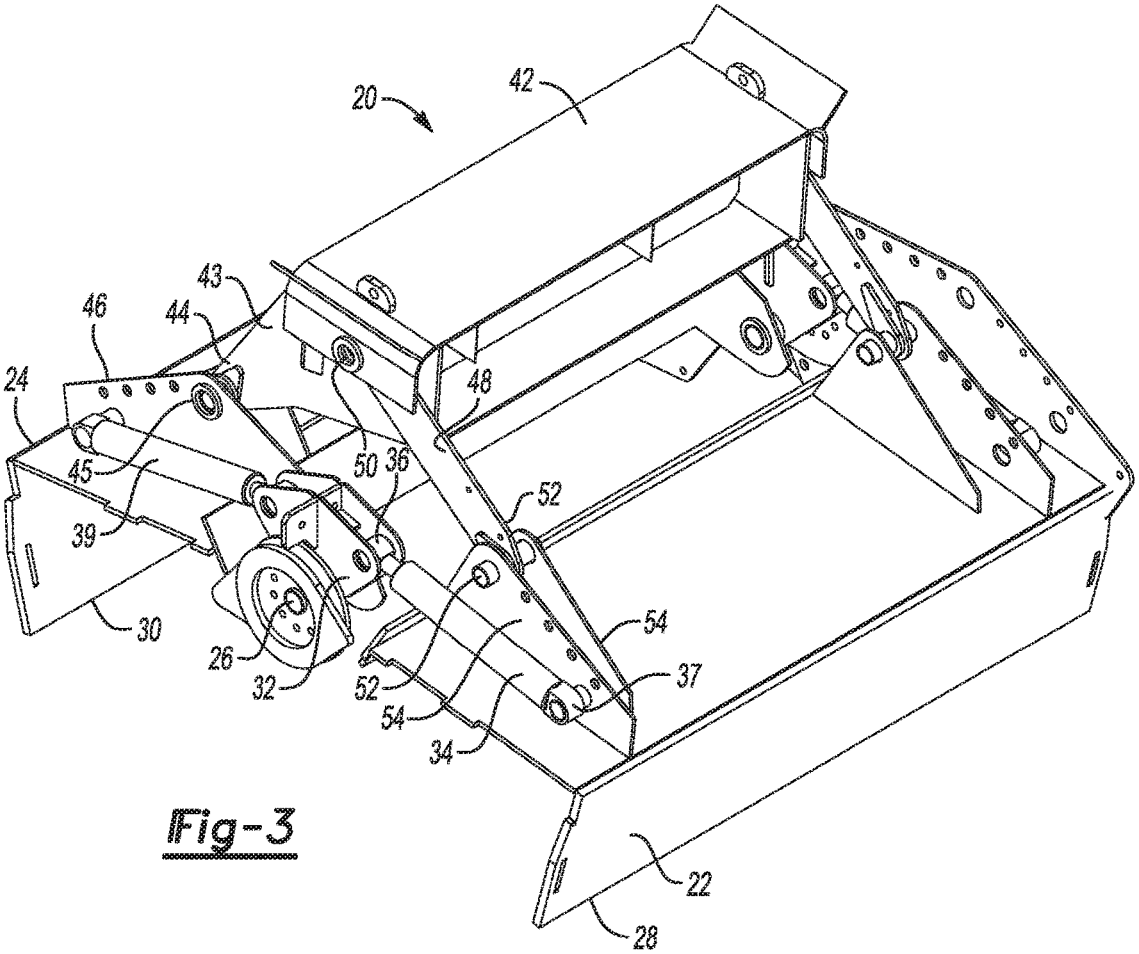
FIG. 3 is an elevational view of a preferred embodiment of the invention in the fully open position and with the end cover removed for clarity.
Figure 4:
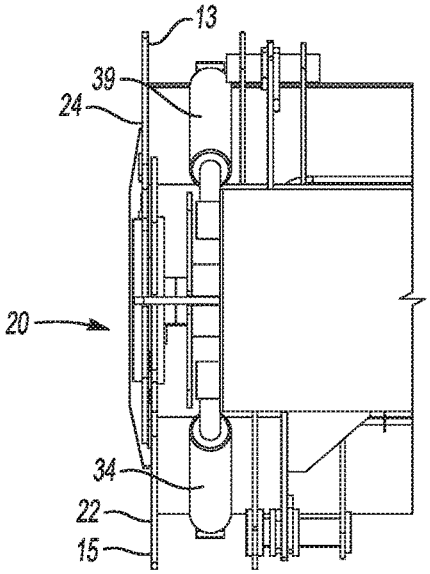
FIG. 4 is a top plan view of the preferred embodiment of the invention and with the bucket in a fully closed position.
Figure 5:
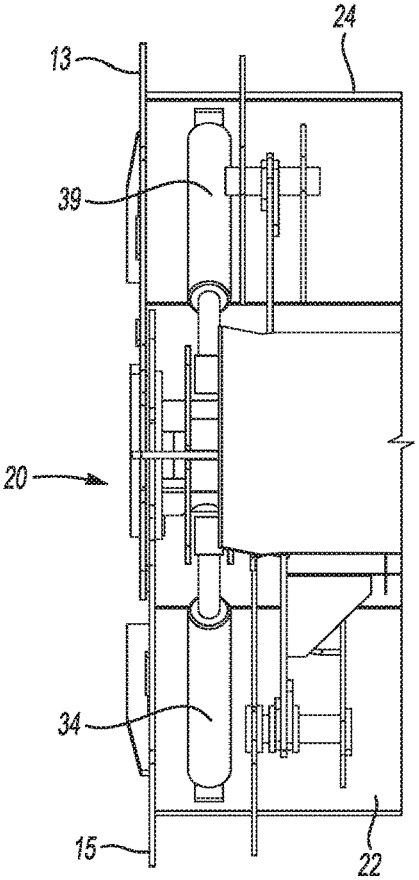
FIG. 5 is a top plan view of the preferred embodiment of the invention and with the bucket in a partially open position.

Referring now to FIGS. 2 and 3, the power bucket halves 22 and 24 are illustrated with their end covers 13 and 15 (see FIGS. 4-9) removed for clarity. Each bucket half 22 and 24 has a cutting edge 28 and 30, respectively, which will move soil into the interior of the power bucket 20 as the bucket halves 22 and 24 move from their open position (FIG. 3) to their closed position (FIG. 1).

With reference now to FIGS. 1-3, in order to move the bucket halves 22 and 24 between their open position, illustrated in FIG. 3, and their closed position, illustrated in FIG. 1, a cylinder bracket 32 is pivotally mounted to the pivot pin 26 on the ends of the bucket 20. A hydraulic cylinder 34 has one end 36 pivotally secured to the cylinder bracket 32. The other end 37 of the hydraulic piston and cylinder 34 is pivotally secured to the power bucket half 22 by a gusset 80 at a position spaced from both the cylinder bracket 32 and the cutting edge 28 of the power bucket half 22. A second hydraulic cylinder 39 is similarly connected between the cylinder support 32 and the other bucket half 24.

Figure 7:
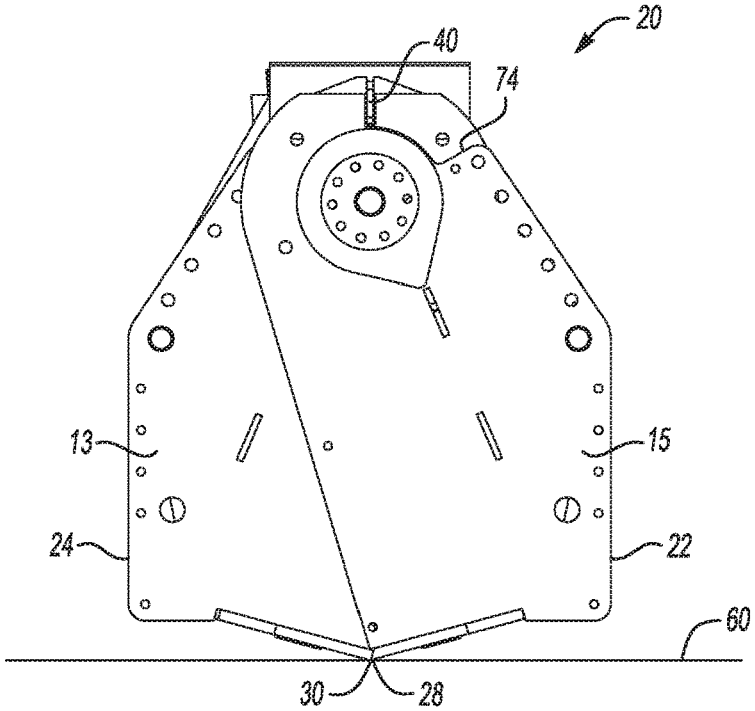
FIG. 7 is an end view of the preferred embodiment of the invention with the bucket in a fully closed position.
Figure 8:
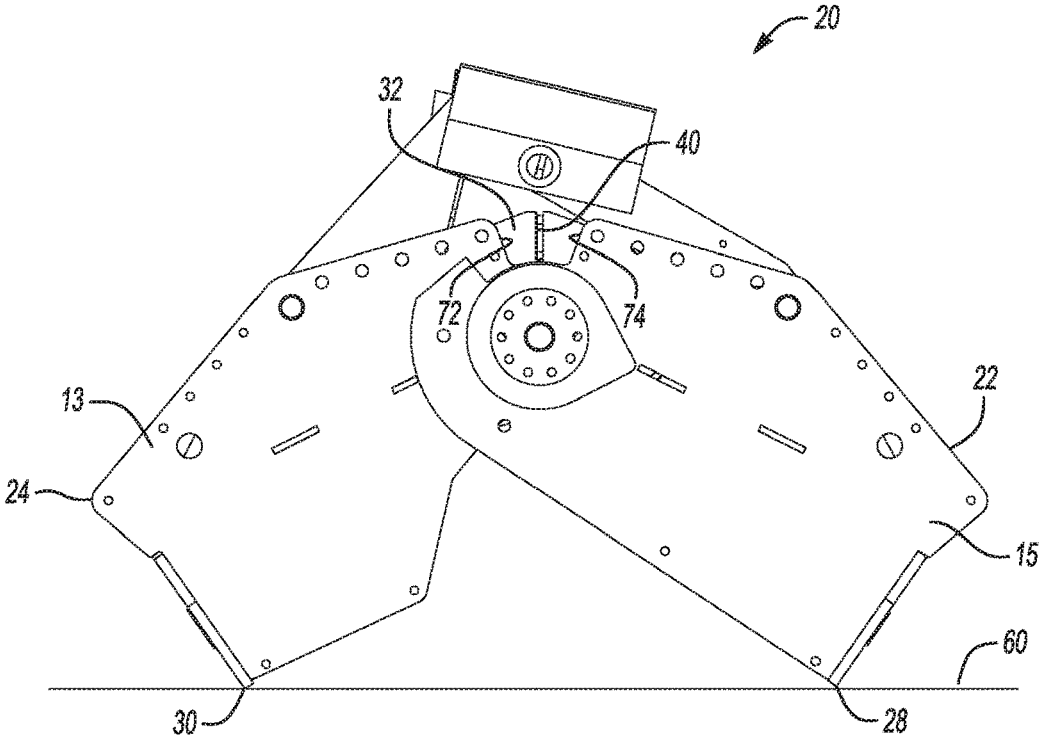
FIG. 8 is an end view of the preferred embodiment of the invention with the bucket in a partially open position.
Figure 9:
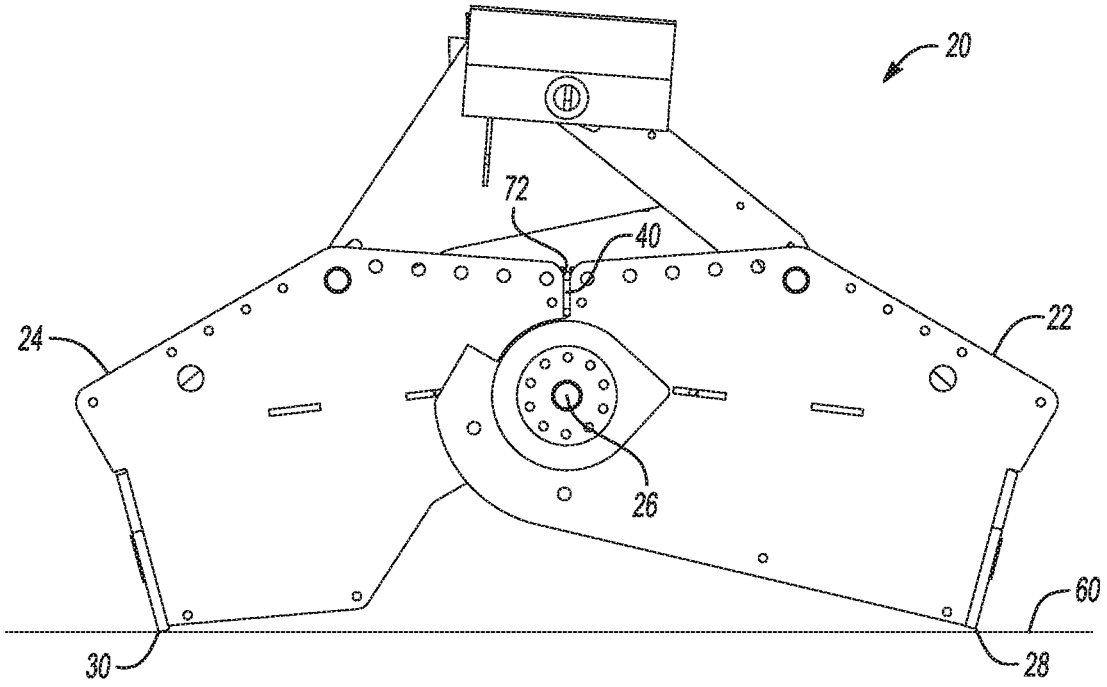
FIG. 9 is an end view of the preferred embodiment of the invention with the bucket in a fully open position.

Consequently, and with reference to FIGS. 1-3 and 7-9, the actuation of the power cylinders 34 and 39 from a retracted position (FIG. 3) to an extended position (FIG. 1) rotatably drives the bucket halves 22 and 24 about the pivot pin 26 between an open position, illustrated in FIGS. 3 and 9, and a closed position, illustrated in FIGS. 1 and 7. Furthermore, in order to limit the maximum opening position of the bucket halves 22 and 24, a stop 40 is secured to and extends outwardly from the cylinder bracket 32. As shown in FIGS. 7-9, this stop 40 then abuts against surfaces 70 and 72 on the end covers 13 and 15, respectively, for the bucket halves 24 and 22, respectively, to limit the maximum open position of the bucket halves 24 and 22.

With reference to FIG. 3, in order to achieve a level cut for the power bucket 20 as the bucket halves 22 and 24 are moved from their open and to their closed positions, a head 42 is positioned across the top of the power bucket 20. A first elongated arm 43 is secured to and extends downwardly from the head 40. A lower free end 44 of the elongated arm 43 is then pivotally connected by pivot pin 45 to one or more gussets 46 fixedly attached to the bucket half 24. Similarly, a second arm 48 is pivotally mounted at a first end by a pivot pin 50 to the head 42 and at its other ends 52 to gussets 54 attached to the bucket half 22 by a pivot pin 56.

As best shown in FIG. 3, the arms 48 and 43 connecting the head 42 to the bucket halves 22 and 24 are shown as pivotally secured to the bucket halves 24 and 22 by pivot pins 45 and 56 and to the head 42 by the single pivot pin 50. Optionally, however, the two arms 43 and 48 and the head 42 may be made in three separate pieces with each arm 43 and 48 pivotally secured at both ends to the head 42 and their respective pivot pins 45 and 56.

Figure 6:
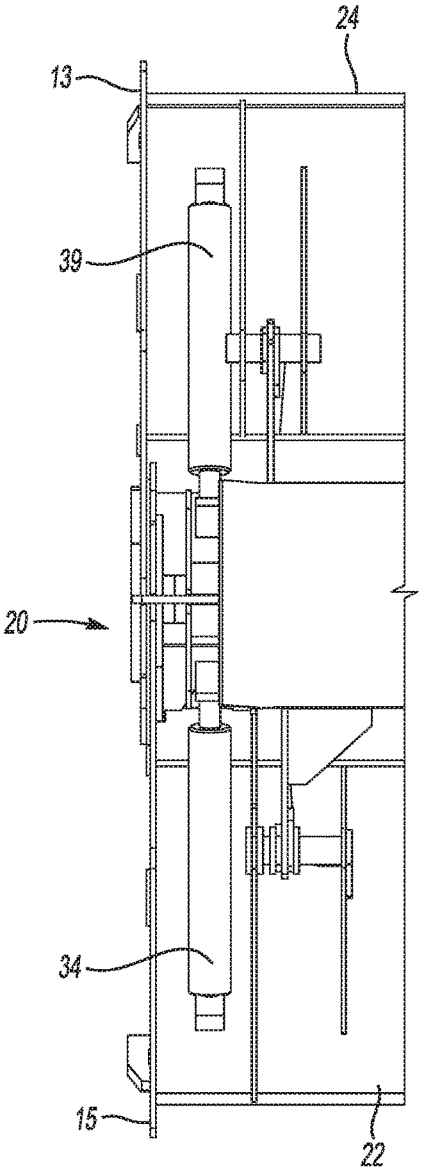
FIG. 6 is a top plan view of the preferred embodiment of the invention and with the bucket in a fully open position.

With reference now to FIGS. 4-9, in operation, the bucket halves 22 and 24 are first moved to their fully open position shown in FIGS. 6 and 9. This allows the entire power bucket 20 to be lowered into the sea floor 60 to the desired depth of cut for the bucket. In this position the cylinders 34 and 39 are fully retracted. Furthermore, as previously described, the stop 40 on the cylinder bracket 32 abuts against surfaces 72 and 74 on both bucket halves 22 and 24 which limits the open most position of the bucket halves 22 and 24.

Thereafter, the power cylinders 34 and 39 are all actuated to move the cylinders 34 and 39 toward their extended position. In doing so, the cutting edges 28 and 30 move substantially along or parallel to the sea floor 60 as shown in FIGS. 7-9.

As the bucket halves 22 and 24 move from their fully open position (FIG. 9) and to their partially closed position (FIG. 7), the power actuators 34 and 39 not only move the bucket halves 22 and 24 towards their closed position, but also elevate the piston pins 26 connecting the bucket halves 22 and 24 together. Furthermore, by controlling the position of the pivotal pin 45 on the arm 43, and similarly the position of the piston pins 50 and 56 connecting the other arm 48 to the other bucket half 22, the vertical rise of the piston pin 26 connecting the bucket halves 22 and 24 together will offset any vertical drop of the bucket halves 22 and 24 during closure. This, in turn, produces a level cut of the sea bed 60.

Further expansion of the power actuators 46 to move the bucket halves 22 and 24 from the position illustrated in FIG. 8 and to the position illustrated in FIG. 7 completes the closure of the bucket halves 22 and 24 while maintaining the cutting edges 28 and 30 substantially horizontal.

From the foregoing, it can be seen that the present invention provides a novel power bucket that produces a level cut that is almost entirely level between a fully open position and a fully closed position of the power bucket. In practice a bucket will only vary less than one inch as the bucket halves are moved between the open and closed positions. Having described my invention, however, many modifications thereto will become apparent to those skilled in the art to which it pertains without deviation from the spirit of the invention as defined by the scope of the appended claims.

I claim:

1. A power bucket comprising:

a first and a second bucket half pivotally secured together about a main axis by at least one pivot pin, said bucket halves being movable between an open and a closed position, a head disposed above said bucket halves, said head having at least one first arm and at least one second arm, said arms being pivotal relative to each other at one end of said arms and said first and second arms pivotally connected to said first and second bucket halves, respectively, at the other ends of said arms, a cylinder bracket pivotally mounted to said pivot pin, a first and a second hydraulic cylinder, said first hydraulic cylinder being pivotally connected at one end to said cylinder support and pivotally connected at its other end to said first bucket half, said second hydraulic cylinder being pivotally connected at one end to said cylinder support and pivotally connected at its other end to said second bucket half.

2. The power bucket as defined in claim 1 wherein said first and second arms are pivotally connected to said first and second bucket halves at a position intermediate the ends of the first and second hydraulic cylinders, respectively.

3. The power bucket as defined in claim 1 and comprising a stop mounted to said cylinder support which limits the maximum open position of said bucket halves.

4. The power bucket as defined in claim 1 wherein said head is fixedly secured to said first arm and pivotally secured to said second arm.

5. The power bucket as defined in claim 1 wherein said bucket halves each have a cutting edge spaced from said main axis and wherein, with said power bucket in said closed position, said main axis is positioned between said cutting edge and an upper end of said cylinder support.

* * * * *